US005469711A

United States Patent [19]

McCoy

[11] Patent Number: 5,469,711

[45] Date of Patent: Nov. 28, 1995

[54] CRYOGENIC PACKAGING FOR UNIFORM COOLING

[75] Inventor: Joseph R. McCoy, Frankfort, N.Y.

[73] Assignee: Infrared Components Corporation, Utica, N.Y.

[21] Appl. No.: 228,215

[22] Filed: Apr. 15, 1994

[51] Int. Cl.[6] ..... F25B 19/00

[52] U.S. Cl. ..... 62/51.1; 62/259.2; 62/383

[58] Field of Search ..... 62/51.1, 383, 259.2

[56] References Cited

U.S. PATENT DOCUMENTS

| | | | |
|---|---|---|---|
| 4,366,680 | 1/1983 | Tward . | |
| 4,501,131 | 2/1985 | Gaskin et al. | 62/383 |
| 4,730,464 | 3/1988 | Lotz | 62/401 |
| 4,739,622 | 4/1988 | Smith | 62/78 |
| 4,783,973 | 11/1988 | Angelier | 62/78 |
| 4,873,833 | 10/1989 | Pfeiffer et al. . | |
| 4,918,928 | 4/1990 | Morioka et al. | 62/383 |
| 4,947,007 | 8/1990 | Dew et al. . | |
| 5,038,571 | 8/1991 | Yokouchi et al. . | |
| 5,105,628 | 4/1992 | Nakai | 62/259.2 |

*Primary Examiner*—Ronald C. Capossela
*Attorney, Agent, or Firm*—Harris Beach & Wilcox

[57] ABSTRACT

A cryogenic package provides a cryogenic environment for devices that require temperatures of 150 K or below, with uniform cooling and minimal thermal stress. A cryocooler produces cold gas on a closed loop, and the gas is distributed in the chamber of a cryogenic vessel. The device housed in the chamber is bathed in a continuous flow of the gas. The warmed gas is returned to the cryogenic cooler.

5 Claims, 2 Drawing Sheets

CRYOGENIC PACKAGING FOR UNIFORM COOLING

BACKGROUND OF THE INVENTION

The present invention relates to cryogenic packages for devices that operate at very low temperatures, i.e., 150K or below. The invention is more concerned with a package which can maintain a low temperature device at an even cryogenic temperature, without subjecting it to thermally induced stresses.

Many present day semiconductor devices exist which must be kept at cryogenic temperatures, e.g. liquid nitrogen temperature or below, in order to operate. One example is a superconductor device which must be kept below a critical temperature $T_c$. Another example is a high speed processor which achieves high carrier mobility only at very cold temperatures. Another example is a low-noise amplifier (LNA) which operates at cryogenic temperatures to reduce the effects of thermal noise. Many of these devices have an irregular shape, which can make conventional cooling difficult.

With present day technology, the device is housed in a Dewar and a cold finger extends into the Dewar. The cold finger typically contacts the device and removes the heat generated in the device. Most preferably, the heat generating part of the device is in thermal contact with the cold finger. The cold finger achieves its cryogenic capacity typically through a closed cycle mechanical refrigerator, or through an open cycle gas expansion, or using a liquid or solid cryogen. The refrigeration achieved at the end of the Cold finger is distributed through conduction, i.e., through a heat-conducting platform, to the device to be cooled. This works well only if the devices are extremely planar, and can withstand thermal stresses. If the device is non-planar in form, temperature distribution becomes uneven, and thermal gradients appear from one part of the device to another.

In cryogenically cooled devices of this type, it is required that temperature distribution be as even as possible, to avoid temperature gradients appearing along thermal conduction paths. Temperature gradients can induce stresses where the materials have variations in their coefficients of thermal expansion (CTE). CTE stress may also result from the platform on which the device is mounted or restrained. These stresses can degrade device performance, and can lead to catastrophic failure where materials are not well matched. Temperature gradients also degrade or induce varying performance in devices, requiring uniform temperatures throughout.

Immersion of the device into a liquid cryogen, e.g. liquid nitrogen, is sometimes used for cryogenic cooling of devices of irregular shape. However, immersion cooling is limited to the boiling temperature of the liquid. For nitrogen, this temperature is about 77K. It is not possible to cool a device in this fashion to a predetermined temperature between helium and nitrogen boiling temperatures. Also, because the cryogen is liquid in form, the system is quite orientation-sensitive and cannot be used in a mobile or space environment where the liquid would not remain in place.

OBJECTS AND SUMMARY OF THE INVENTION

It is an object of this invention to provide an improved closed-cycle cryocooler that avoids the drawbacks of the prior art.

It is another object to provide a cryocooler system in which the object to be cooled is immersed in a bath of the cryogen having a continuous, regulated flow, to maintain a desired operation temperature.

It is a further object to provide a cryogenic package which maintains an even working temperature and which avoids temperature gradients along the device.

According to an aspect of the present invention, a cryogenic package is provided for cooling of a device to be operated at a cryogenic temperature. A cryogenic vessel, e.g. a double-walled Dewar, defines a thermally insulated chamber which houses the device. Electrical conductors penetrate the walls of the vessel, but the penetrations are sealed to prevent flow of heat or of the cryogen. The electrical conductors carry signals between the device and an electrical connector disposed outside the vessel. The signal penetrations are not limited to electrical conductors but could be optical fibers or waveguides. A cryogen generator has an inlet port for receiving cold cryogen gas, an outlet port for discharging the cryogen gas; and heat discharge means for removing heat from the cryogen gas so that the gas discharged out the outlet port is at a desired cryogenic temperature. A first conduit feeds the cryogen gas from the outlet port into the chamber, and a second conduit carries the gas from the chamber back to the inlet port. The cryogen circulates in a closed loop such that the device is continuously bathed in the cryogen gas at the desire cryogenic temperature. Because the entire device is bathed in the cryogen gas, temperature gradients along the device are avoided.

In some embodiments, the device can be an infrared sensor device, and the vessel can have a window therein which permits certain wavelengths to pass into the chamber.

The vessel is not limited to double-wall Dewars. Instead any suitably insulated vessel could be used.

The above and many other objects, features and advantages will become apparent from persons skilled in the art from a perusal of the accompanying Description, to be read in connection with the accompanying Drawing.

DETAILED DESCRIPTION OF THE PREFERRED EMBODIMENT

Figure 1:
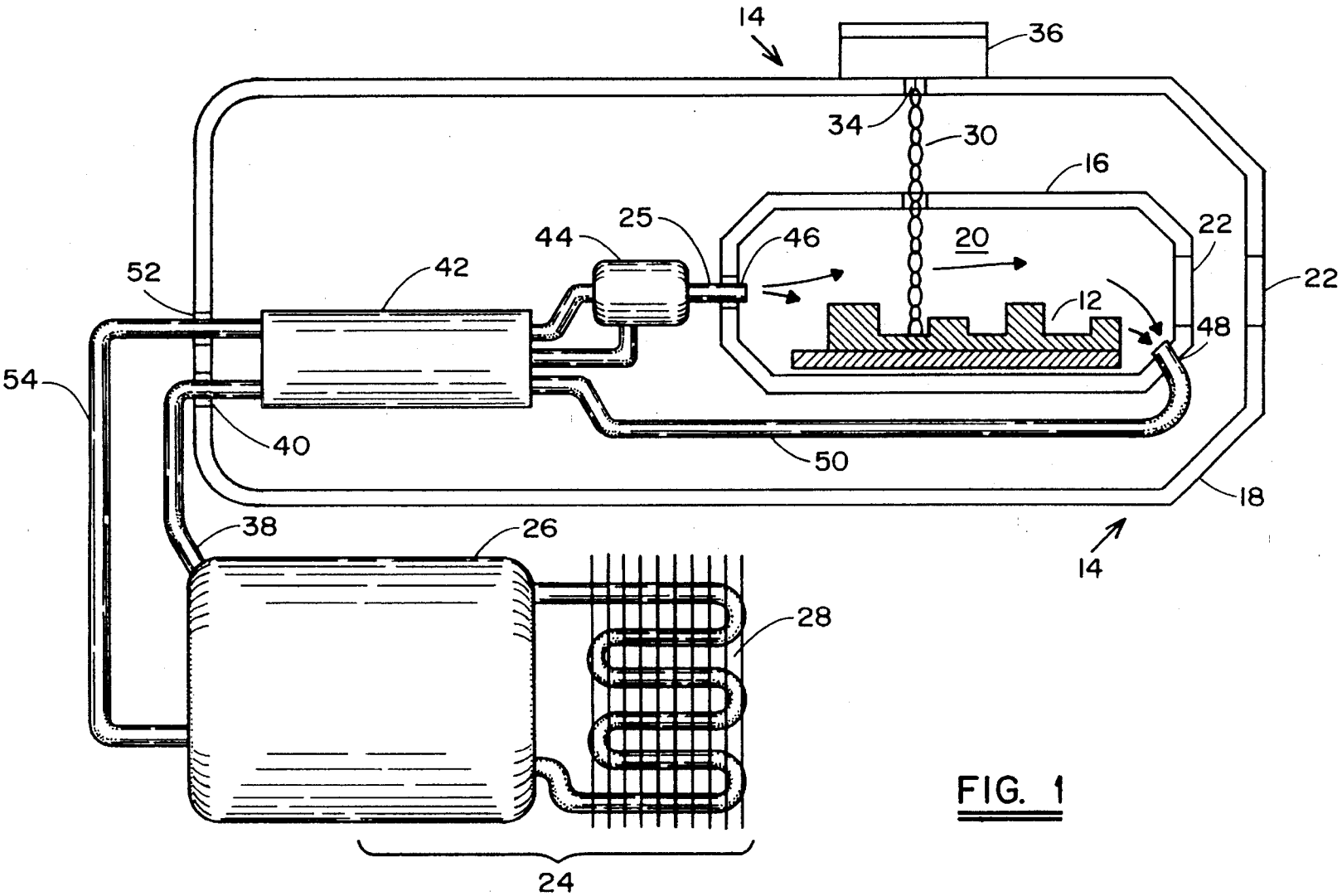
FIG. 1 is a schematic elevation of a cryogenic package according to an embodiment of the invention.

With reference to the Drawing, and initially to FIG. 1, a cryogenic package 10 is configured to house a semiconductor device 12 which is to be kept during operation, at a particular cryogenic temperature, e.g. 50K. The package 10 has a vessel 14 made up of an inner double-wall Dewar 16 inside an outer double-wall Dewar 18. The inner Dewar 16 defines a chamber 20 in which the device 12 is maintained at a low temperature. In the event that the device 12 is an infrared sensor, the Dewars 16, 18 can each have an end Window 22 which permits some predetermined selected wavelengths, e.g. infrared, to pass.

A cryogenic cooler 24, which in this case can be a reverse Brayton cooler, has a conduit 25 connected to the inside of the chamber 20. The cooler 24 includes a compressor 26 outside the vessel 14 with a finned heat exchanger 28 which discharges heat into the environment.

A number of electrical conductors 30 are attached to circuit points on the device 12. These pass through a sealed penetration 32 through the inner double wall Dewar 16 and through another similar sealed penetration 34 in the outer double-wall Dewar 18. The conductors 30 terminate at an electrical coupler 36 on the outer wall of the outer Dewar 18.

Figure 2:
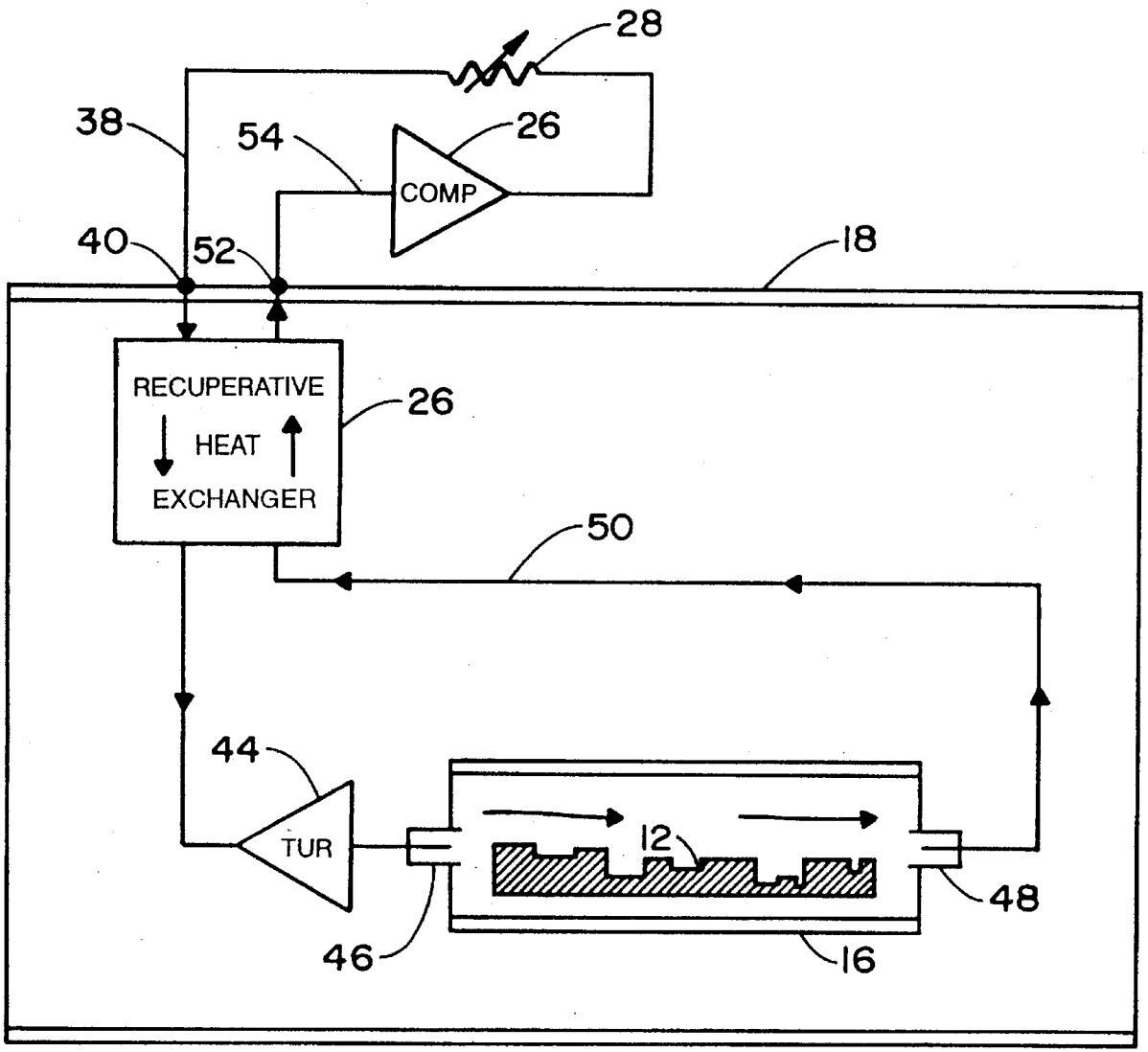
FIG. 2 is a schematic view of this embodiment.

As shown in FIG. 1 and also shown schematically in FIG. 2, the package 10 is configured as a closed loop system. The cryogenic gas is compressed in the compressor 26, and travels via a gas line 38, through a port 40 which penetrates the outer Dewar 18, to a recuperative heat exchanger 42 and thence to an expansion turbine 44. The latter expands the refrigerant gas, e.g. neon, which travels through a port 46 in the inner Dewar 16 into the chamber 12. There is a continuous flow of gas at a cryogenic temperature e.g. 50K, over the device 12 and out an exhaust port 48 in the inner Dewar 16. The gas then travels through a return conduit 50 to the recuperative heat exchanger 42, where it removes heat from the incoming gas from the compressor 26. The gas leaves the heat exchanger 42, passes through a penetration 52 in the outer dewar 18, and returns through tubing 54 to an intake port of the compressor 26. The cryocooler 24 regenerates the cryogenic gas and creates a pressure differential between the port 46 and the port 48, which results in flow through the vessel chamber 20.

The surrounding vessel 14 provides thermal isolation to minimize loading on the pressure/gas distribution. Instead of the double-Dewar construction, other means of thermal isolation could be employed. Temperature sensors, not shown, within the vessel provide feedback information to the cryocooler 24 to control the cryogen production rate. Many different well known vacuum penetrations, Dewar materials, and manufacturing processes could be employed with this embodiment.

Other types of cryocoolers could be employed, such as a Stirling cycle refrigerator. In this embodiment, a reverse Brayton cryogenic cooler is employed because of its ability to produce a continuous flow of cryogenic gas. Here a single-stage cryocooler is used, but a multiple stage arrangement could be employed.

The integrated cryogenic package of this invention operates with long life (50,000 hours or more) at low vibration and with minimal thermal stress. The package provides a cryogenic environment (below 150K) for devices with non-traditional or arbitrary form factors, and is small and economical.

While the invention has been described with reference to a single preferred embodiment, it should be understood that the invention is not limited to that embodiment. Rather, many modifications and variations will present themselves to persons skilled in the art without departing from the scope and spirit of this invention, as defined in the appended claims.

What is claimed is:

1. A cryogenic packaging for even cryogenic cooling of an operating electronic device, comprising:

a cryogenic vessel having a sealed chamber for containing an operating electronic device, said cryogenic vessel thermally isolating said sealed chamber from an outside environment;

signal carder means penetrating said cryogenic vessel and said sealed chamber for carrying electrical signals between an operating electronic device contained in said sealed chamber and a connector disposed outside said cryogenic vessel;

a cryogen generator including an inlet port for receiving a cryogenic gas; an outlet port for discharging said cryogenic gas; and heat discharge means for removing heat from the cryogenic gas so that the discharged gas is at a desired cryogenic temperature;

first conduit means coupling said cryogenic gas discharged from said outlet port through said heat discharge means into said sealed chamber; and second conduit means for carrying said cryogenic gas from said sealed chamber through said heat discharge means to said inlet port so that an operating electronic device contained therein is continually bathed in said cryogenic gas at said cryogenic temperature so that temperature gradients along the operating electronic device contained therein are avoided.

2. The cryogenic package according to claim 1 wherein said vessel includes an outer double-wall Dewar, and an inner double-wall Dewar positioned inside the outer double-wall Dewar, the inner Dewar defining said chamber therewithin.

3. The cryogenic package according to claim 1 wherein said vessel has a window permitting selected wavelengths of radiation to pass through.

4. The cryogenic package according to claim 1 wherein said cryogenic gas is neon.

5. The cryogenic package according to claim 1 wherein said cryogen generator includes a reverse Brayton cycle device.

* * * * *